US011053782B2

(12) United States Patent
Loehken et al.

(10) Patent No.: US 11,053,782 B2
(45) Date of Patent: Jul. 6, 2021

(54) PERFORATING GUN SYSTEM AND METHOD OF USE

(71) Applicant: DynaEnergetics GmbH & Co. KG, Troisdorf (DE)

(72) Inventors: Joern Olaf Loehken, Troisdorf (DE); Denis Will, Troisdorf (DE); Bernd Fricke, Hannover (DE); Atakan Sever, Troisdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 145 days.

(21) Appl. No.: 16/258,810

(22) Filed: Jan. 28, 2019

(65) Prior Publication Data

US 2019/0309606 A1 Oct. 10, 2019

Related U.S. Application Data

(63) Continuation-in-part of application No. 16/002,217, filed on Jun. 7, 2018, now Pat. No. 10,520,286.
(Continued)

(51) Int. Cl.
*E21B 43/117* (2006.01)
*F42B 1/028* (2006.01)
(Continued)

(52) U.S. Cl.
CPC ..... *E21B 43/117* (2013.01); *F42B 1/028* (2013.01); *E21B 43/26* (2013.01); *F42B 3/08* (2013.01)

(58) Field of Classification Search
CPC .. F42B 1/02; F42B 1/024; F42B 1/028; F42B 1/032; F42B 1/036; F42B 3/08;
(Continued)

(56) References Cited

U.S. PATENT DOCUMENTS 3,251,300 A * 5/1966 Reyne ..... E21B 43/117 102/310
4,063,512 A 12/1977 Davis
(Continued)

FOREIGN PATENT DOCUMENTS

EP 0184622 A2 6/1986
EP 0773425 B1 5/1997
(Continued)

OTHER PUBLICATIONS

Waters & Wang, The Impact of Geomechanics and Perforation on Hydraulic Fracture Initiation & Complexity in Horizontal Well Completions, Sep. 26-28, 2016, SPE-181684-MS, 36 pg.
(Continued)

*Primary Examiner* — James S Bergin
(74) *Attorney, Agent, or Firm* — Moyles IP, LLC

(57) ABSTRACT

According to some embodiments, a shaped charge inlay includes an upper edge that extends inward and horizontal to an edge of a shaped charge casing associated with a shaped charge. The shaped charge includes an existing liner and the shaped charge inlay further includes a body that extends inward toward an apex of the existing liner. The shaped charge inlay may be disposed above the existing liner in the shaped charge, to disrupt collapse of the existing liner upon detonation of the shaped charge and thereby change the geometry of a perforating jet and resulting perforation created by the shaped charge. The perforation holes formed by shaped charges having the shaped charge inlay may have geometries that include constant open areas to flow in the target when the perforating gun is centralized or decentralized in a wellbore casing.

10 Claims, 16 Drawing Sheets

Related U.S. Application Data

(60) Provisional application No. 62/654,306, filed on Apr. 6, 2018.

(51) Int. Cl.
*F42B 3/08* (2006.01)
*E21B 43/26* (2006.01)

(58) Field of Classification Search
CPC .... E21B 43/116; E21B 43/117; E21B 43/118; E21B 43/119
USPC ..... 102/306, 307, 308, 309, 310; 89/1.15; 166/55, 55.1, 55.2, 297, 298; 175/4.55, 175/4.6
See application file for complete search history.

(56) References Cited

U.S. PATENT DOCUMENTS

| | | | | |
|---|---|---|---|---|
| 4,702,171 | A | 10/1987 | Tal et al. | |
| 4,862,804 | A | 9/1989 | Chawla et al. | |
| 5,565,644 | A | 10/1996 | Chawla | |
| 5,753,850 | A | 5/1998 | Chawla et al. | |
| 6,401,818 | B1 * | 6/2002 | Papanastasiou | E21B 43/117 102/313 |
| 6,510,796 | B2 | 1/2003 | Mayseless et al. | |
| 7,712,416 | B2 | 5/2010 | Pratt et al. | |
| 7,789,153 | B2 | 9/2010 | Prinz et al. | |
| 7,987,911 | B2 | 8/2011 | Rhodes et al. | |
| 8,156,871 | B2 | 4/2012 | Behrmann et al. | |
| 8,418,622 | B1 | 4/2013 | Pham et al. | |
| 8,505,454 | B2 | 8/2013 | Boyer et al. | |
| 9,612,093 | B2 | 4/2017 | Collier et al. | |
| 9,651,263 | B2 * | 5/2017 | Collier | F42C 19/12 |
| 9,702,669 | B1 | 7/2017 | Powell | |
| 9,725,993 | B1 | 8/2017 | Yang et al. | |
| 10,000,994 | B1 * | 6/2018 | Sites | F42B 1/028 |
| 10,364,387 | B2 * | 7/2019 | Collier | C09K 8/62 |
| 10,480,295 | B2 * | 11/2019 | Walker | E21B 43/117 |
| 10,520,286 | B2 * | 12/2019 | Loehken | E21B 43/117 |
| 10,533,401 | B2 * | 1/2020 | Hinton | F42B 1/036 |
| 10,774,624 | B2 * | 9/2020 | Yang | E21B 43/116 |
| 2001/0052303 | A1 | 12/2001 | Mayseless et al. | |
| 2003/0183113 | A1 | 10/2003 | Barlow et al. | |
| 2009/0050321 | A1 | 2/2009 | Rhodes et al. | |
| 2011/0155013 | A1 | 6/2011 | Boyer et al. | |
| 2015/0316360 | A1 | 11/2015 | Hinton et al. | |
| 2016/0153267 | A1 | 6/2016 | Walker et al. | |
| 2016/0349021 | A1 | 12/2016 | Collier et al. | |
| 2018/0094910 | A1 | 4/2018 | Montoya Ashton et al. | |
| 2020/0040714 | A1 * | 2/2020 | Surjaatmadja | E21B 33/138 |

FOREIGN PATENT DOCUMENTS

| | | | |
|---|---|---|---|
| GB | 2303687 | A | 2/1997 |
| WO | WO-2005103602 | A1 | 11/2005 |
| WO | 2019117874 | A1 | 6/2019 |

OTHER PUBLICATIONS

Stephen Rassenfoss, Rethinking Fracturing at the Point of Attack, Apr. 1, 2018, 6 pgs, https://www.spe.org/en/print-article/?art=4007.

Andy Martin & Harvey Williams, Fracture Initiation from Perforations, presentation at Schlumberger, IPS-14-02, May 12, 2014, 33 pgs.

David Cuthill, Weatherford, Experiences with Advanced Perforating Systems, paper presented at 2008 International Perforating Symposium, 23 pgs.

International Search Report and Written Opinion of International App. No. PCT/EP2019/054442, dated May 21, 2109, which is in the same family as U.S. Appl. No. 16/258,810, 14 pgs.

* cited by examiner

PERFORATING GUN SYSTEM AND METHOD OF USE

CROSS-REFERENCE TO RELATED APPLICATIONS

This application is a continuation-in-part of U.S. application Ser. No. 16/002,217 filed Jun. 7, 2018, which claims the benefit of U.S. Provisional Application No. 62/654,306 filed Apr. 6, 2018, each of which is incorporated herein by reference in its entirety.

FIELD OF THE DISCLOSURE

Devices, systems, and methods for perforating, among other things, wellbore structures and oil and gas deposit formations are generally disclosed. More specifically, devices, systems, and methods for creating constant open areas to flow in a target and for adapting a geometry of a perforating jet and resulting perforation are disclosed.

BACKGROUND OF THE DISCLOSURE

Perforating gun assemblies are used in many oilfield and gas well completions. The perforating gun assemblies are usually cylindrical and include a detonating cord arranged within the interior of the assembly and connected to shaped charges, hollow charges or perforators disposed therein. Shaped charges are explosive components configured to focus ballistic energy onto a target. When the detonating cord initiates the explosive load within the shaped charge, a liner and/or other materials within the shaped charge are collapsed and propelled out of the shaped charge in a perforating jet of thermal energy and solid material. In particular, the shaped charges may be used for, among other things, any or all of generating holes in downhole pipe/tubing (such as a steel casing) to gain access to an oil/gas deposit formation and to create flow paths for fluids used to clean and/or seal off a well and perforating the oil/gas deposit formation to liberate the oil/gas from the formation. The shaped charges may be designed such that the physical force, heat, and/or pressure of the perforating jet, expelled materials, and shaped charge explosion will perforate or form entrance openings/holes in the target, which may include, among other things, steel, concrete, and geological formations. The diameters of the entrance openings typically depend on, at least in part, the centralization or the decentralization of the perforating gun in the wellbore, the shaped charges and the constituents and shape of the liner housed within each shaped charge, among other things. While initial design parameters may target specific diameters for the entrance openings, the aforementioned factors may result in variation/variation of the diameters. Such variations can lead to challenges in, for example, fracturing processes, which include the injection of fluid into the underground formation to force open cracks or fissures in the formation. The diameter of the entrance openings may negatively impact the distribution of fluid during the fracturing process by, for example, deviating from the target diameters due to decentralization of the perforating gun in the wellbore. Variations in the entrance hole diameters may also result in an unpredictable pressure drop, which may negatively impact the fracturing process.

Shaped charges for perforating guns used in wellbore operations come in many shapes/geometries. For example, shaped charges typically may be hemispherical, conical, frustoconical, or rectangular. The shape of the shaped charge in part determines the geometry of the perforating jet and/or perforation (hole) that is produced by the charge upon detonation. Hemispherical, conical, and frustoconical shaped charges (collectively, conical shaped charges or rotational symmetric shaped charges) tend to produce round/(semi-)circular perforations, while rectangular, or "slotted", shaped charges tend to produce rectangular and/or linear perforations ("slots"). Particular geometries may be useful for specific applications in wellbore operations. For example, conical charges may produce a concentrated perforating jet that penetrates deep into a geological formation, to enhance access to oil/gas formations. Slotted shaped charges may produce linear perforations that can overlap each other in a helical pattern, and thereby perforate a cylindrical target around all 360° of the target. Such a pattern may be useful during abandonment of a well, where concrete is pumped into the well and must reach and seal substantially all areas of the wellbore.

One disadvantage of typical shaped charges is that they may generate perforations having varied entrance hole diameters or open entrance areas, varied perforating tunnel lengths and/or varied perforating tunnel shapes. For example, the sizes of each entrance opening may vary at least in part by one or more wellbore conditions, including one or more of the position of the perforating gun in the casing, the thickness or composition of the casing, the position of the shaped charge in the perforating gun, the type of hydrocarbon formation in which the perforating gun is disposed and the local stress field. Current systems and methods to accommodate for these variations include the use of big hole shaped charges (i.e., shaped charges having modified liners that facilitate the creation of large perforation holes in a target). One disadvantage of such big hole shaped charges is that they can lead to unreliable and unpredictable entrance hole sizes (e.g., entrance hole diameters (EHD)) and poor penetration in the target. Other systems and methods, such as described in U.S. Pat. No. 9,725,993, include the use of shaped charges having liners with subtended angles to minimize variation of the EHD of perforations. One disadvantage of such systems and methods is that a subtended angle for the liner does not necessarily, by itself, achieve constant EHD because there are a variety of design specifications for a shaped charge that determine the jet, and therefore the perforation properties.

Yet another disadvantage of typical shaped charges is that the geometry of the shaped charge and associated perforating jet is set when the shaped charge is manufactured according to corresponding specifications. As such, a particularly-styled shaped charge must be kept on hand for each respective application in which a particular shaped charge is used. The limited, particularized use of different shaped charges thereby increases the costs and efforts associated with, e.g., manufacturing smaller batches of shaped charges, holding inventory of specific shaped charges, and transporting and keeping various styles of shaped charges at a job site.

Based at least on the above considerations, there is a need for a liner and shaped charged design that creates an entrance hole having a geometry that increases fluid flow and reduces the breakdown pressure. Further, there is a need for a liner and a shaped charge design that creates an entrance hole having a diameter that is unaffected by design and environmental factors. These and other benefits are further served by devices, systems, and associated methods that are economical, adaptable to a variety of shaped charges and applications, and simple to execute.

BRIEF DESCRIPTION OF THE EXEMPLARY EMBODIMENTS

Some exemplary embodiments described herein relate to a shaped charge inlay for use with a liner in a shaped charge. The shaped charge inlay is secured to the liner, and includes an upper edge, and a distal edge opposite the upper edge. The upper edge may extend inwardly from an edge of a shaped charge case associated with a shaped charge. The shaped charge inlay further includes a body that extends between the upper and distal edges, and toward an apex of the liner. According to an aspect, at least a portion of the shaped charge inlay covers a portion of the liner that is away from the apex of the liner. The shaped charge inlay is disposed above the liner in the shaped charge in a manner that disrupts the collapse of the liner upon detonation of the shaped charge, thereby changing the geometry of a perforating jet and/or perforation created by the shaped charge. The shaped charge inlay adapts shaped charges so that the shaped charge can be used to create atypical perforation hole geometries, regardless of the shape of the case of the shaped charge. The atypical hole geometries are different than the standard perforating hole geometry that would be formed in the absence of the shaped charge inlay.

The present disclosure further describes a shaped charge inlay including an upper edge, a continuous ring formed at the upper edge, and a plurality of fingers extending from the continuous ring. The fingers are arranged in a manner that forms an open apex opposite the continuous ring. The shaped charge inlay is particularly suited for use with a liner in a shaped charge and is configured to transform a perforating jet to create atypical perforating hole geometries. According to an aspect, the atypical perforation hole geometries are based in part on the quantity/number of the fingers.

According to an aspect, the shaped charge inlays described hereinabove are particularly suited for use in shaped charges. Such shaped charges include a case having a hollow interior, an explosive load disposed within the hollow interior, and a liner disposed adjacent the explosive load. A shaped charge inlay, substantially as described hereinabove, is disposed adjacent the liner so that upon detonation of the shaped charge, an atypical perforation hole is formed.

The present embodiments also relate to a method of changing a perforating jet geometry of a shaped charge. The method includes securing a shaped charge inlay in a shaped charge. The inlay and the shaped charge may be substantially as described hereinabove. The shaped charge inlay may be coupled or otherwise secured to the shaped charge. The method further includes detonating the shaped charge to form a perforating jet that produces an atypical perforation hole geometry in a target or formation.

Embodiments of the disclosure are associated with shaped charges, for use with perforating guns, that create constant open areas to flow in a target. As used herein, constant open areas correspond to constant entry hole diameters (EHD), but particularly refers to the entry openings for non-circumferential geometries. The shaped charges each include a shaped charge case comprising a hollow interior, an explosive load disposed within the hollow interior, and a liner disposed adjacent the explosive load. A shaped charge inlay may be disposed on top of at least a portion of the liner. Upon detonation, each shaped charge forms a perforating jet that each creates an atypical perforation hole geometry in a target. The created atypical perforation hole geometries include constant open areas to flow in the target. The constant open areas to flow are created when the perforating gun is centralized or even decentralized in a wellbore casing and have a variation (or deviation) of less than 10%.

Embodiments of the disclosure related to methods of perforating a wellbore. The method includes positioning a perforating gun including a plurality of shaped charges in an underground formation and detonating the shaped charges to create/form slot-shaped perforation hole geometries in a target of the underground formation. The slot-shaped perforation hole geometries created include constant open areas to flow in the target with a variation of less than 10%. The method further includes injecting a fluid into the wellbore to fracture the underground formation. Since the detonation of the shaped charges creates an optimal elongated opening in the form of the slot-shaped perforation hole geometries in the target, this reduces erosion of the perforation hole. An increased amount of fluid may flow through the slot-shaped perforation hole, as compared to round holes. In addition, the slot-shaped perforation hole geometry may reduce the breakdown pressure required for fracking operations. This may be even further reduced if the slot shape is aligned with the frac plane.

Further embodiments of the disclosure are associated with a method of creating slot-shaped perforations in a wellbore in an underground formation. The method includes positioning a perforating gun including a plurality of conical shaped charges in the wellbore, and detonating the conical shaped charges into the underground formation. The conical shaped charges each include a shaped charge case comprising a hollow interior, a liner disposed adjacent the explosive load, and a shaped charge inlay disposed on top of a portion of the liner. According to an aspect, at least a portion of the liner is between the inlay and the explosive load. Upon detonation, each shaped charge and corresponding inlay forms a perforating jet that creates a slot-shaped perforation hole geometry in the underground formation. The slot-shaped perforation hole geometries formed by the plurality of conical shaped charges include constant open areas to flow, having a variation that is less than 10%. This allows all of the slot-shaped perforation holes to facilitate fluid flow and contribute to the fracturing process.

In various exemplary embodiments, the disclosed devices, systems, and methods may result in perforation geometries that are, e.g., rectangularly-shaped, triangularly-shaped, cross-shaped, star-shaped, and the like.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1A:
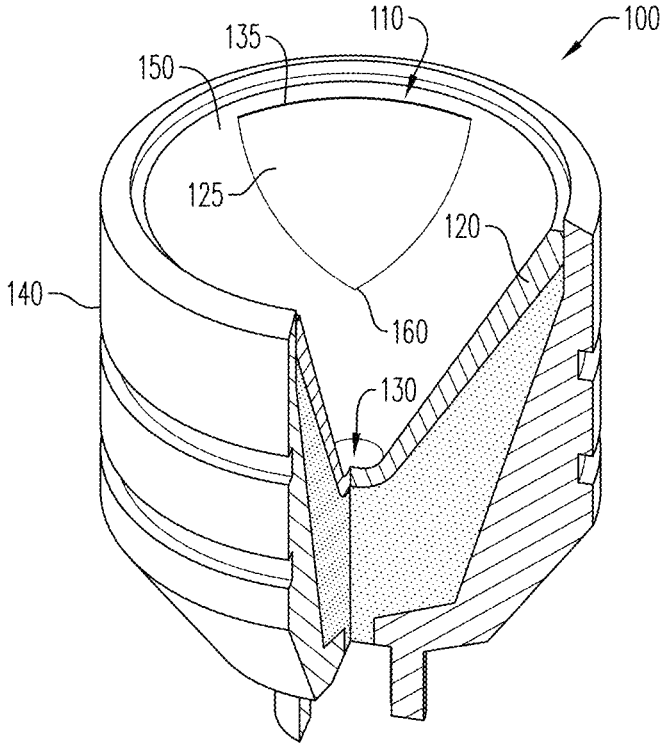
FIG. 1A is a perspective view of a conical shaped charge including a shaped charge inlay, in accordance with an exemplary embodiment.

Various features, aspects, and advantages of the embodiments will become more apparent from the following detailed description, along with the accompanying figures in which like numerals represent like components throughout the figures and text. The various described features are not necessarily drawn to scale but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

For purposes of this disclosure, the phrases "device(s)", "system(s)", and "method(s)" may be used either individually or in any combination referring without limitation to disclosed components, grouping, arrangements, steps, functions, or processes.

The exemplary embodiments relate generally to a shaped charge inlay that is coupled to an existing liner of a shaped charge, to change a particular geometry of a perforating jet and/or perforation produced by the shaped charge. For example, the shaped charge inlay may be coupled to the existing liner of a conical shaped charge so that detonation of the conical shaped charge causes a rectangularly-shaped perforation and/or linear slots instead of a round/circular perforation. The shaped charge inlays described herein may change a shape of the perforation produced by the perforating jet and may not necessarily affect a size of the perforation hole.

For purposes of illustrating features of the embodiments, a simple example will now be introduced and referenced throughout the disclosure. This example is illustrative and not limiting and is provided purely for explanatory purposes.

Figure 1B:
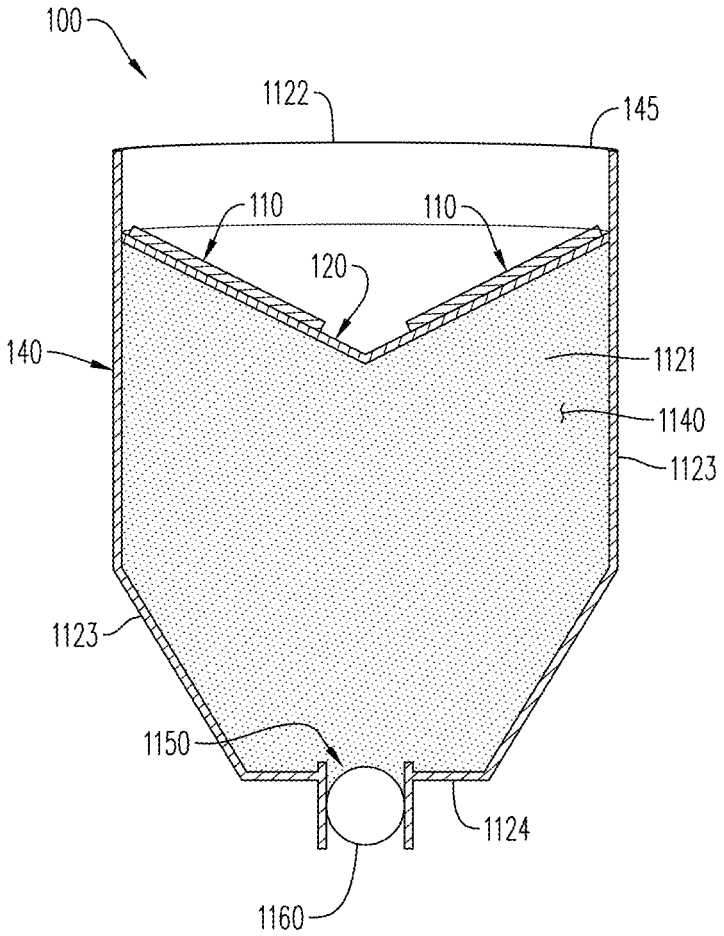
FIG. 1B is a cross-sectional view of a shaped charge including a shaped charge inlay, in accordance with an exemplary embodiment.
Figure 2:
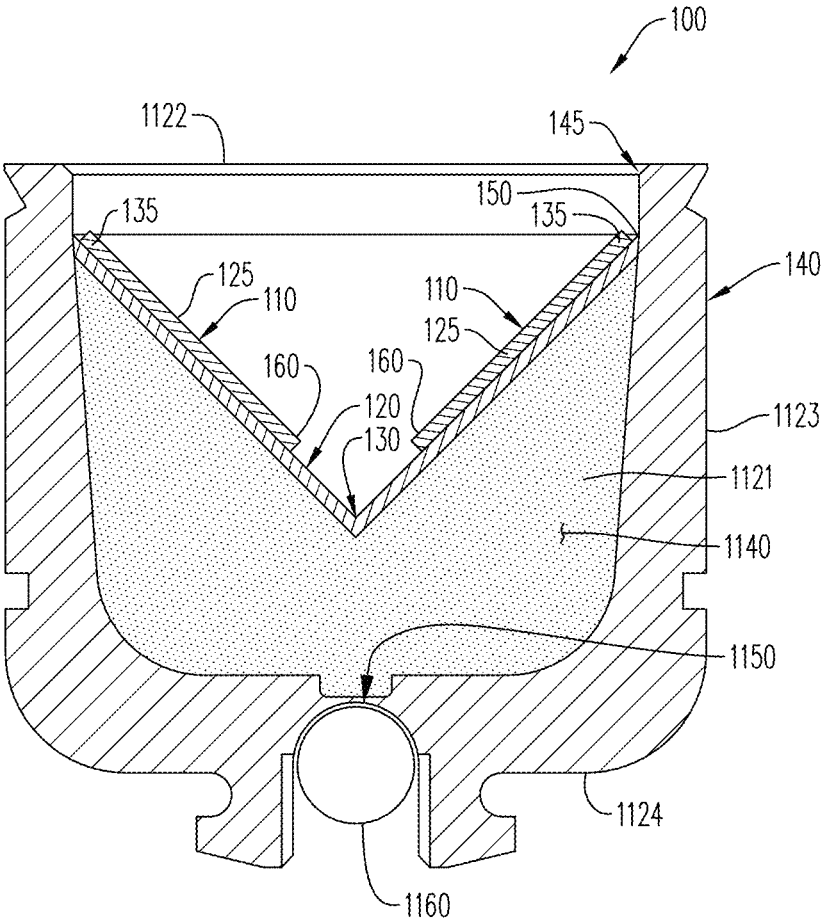
FIG. 2 is a cross-sectional view of a shaped charge including a shaped charge inlay, in accordance with an exemplary embodiment.

With reference to FIGS. 1A, 1B and 2, a typical shaped charge 100 is shown. The shaped charge 100 includes a case 140 that defines an overall geometry of the shaped charge 100. The case 140 may be formed from machinable steel, aluminum, stainless-steel, copper, zinc, and the like. According to an aspect and as illustrated in FIG. 1, the case 140 is substantially frustoconical.

The shaped charge 100 includes a shaped charge inlay 110, in accordance with an embodiment. The shaped charge inlay 110 may be formed from a rigid material or semi-rigid material such as a plastic material or polymer such as polyamide, a metal, a combination of such materials, or other materials consistent with this disclosure. The shaped charge inlay 110 may be formed from a rubber material. According to an aspect, the shaped charge inlay 110 includes an upper edge 135 and a distal edge 160 opposite the upper edge 135. The inlay 110 may further include a body 125 that extends between the upper edge 135 and the distal edge 160. The body 125 may include a triangular shape, as defined by the upper edge 135 and the distal edge 160 of the inlay 110. According to an aspect, the shaped charge inlay 110 is attached or otherwise secured to the existing liner 120 and/or the shaped charge casing 140 by a number of techniques, as described hereinabove.

Figure 2A:
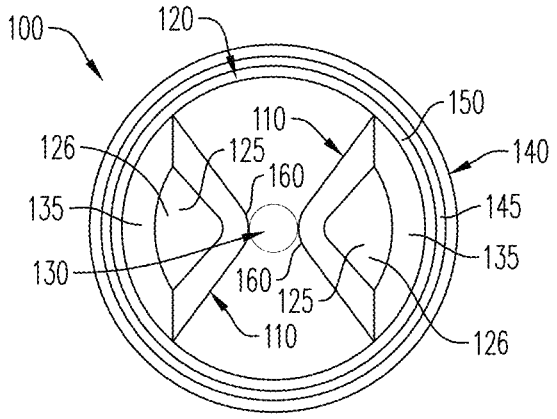
FIG. 2A is a top view of a shaped charge including a shaped charge inlay, in accordance with an exemplary embodiment.

As illustrated in the exemplary embodiment of FIG. 1A, the shaped charge inlay 110 may extend from an upper edge 150 of the liner 120 towards a center or apex 130 of the liner 120. In some embodiments, the shaped charge inlay 110 does not overlap the apex 130. As illustrated in FIGS. 1A and 2A, the distal edge 160 of the inlay 110 may be oriented towards the apex 130 of the existing liner 120. In some embodiments, upper edge 135 is larger than the distal edge 160, and both edges 135, 160 may generally define a shape of the body 125 of the inlay 110. The body 135 of the inlay 110 may include an indented area 126 configured to facilitate a partial disruption of the perforating jet in order to form the desired atypical perforation hole geometry. According to an aspect the indented area 126 may extend from the upper edge 135 to the distal edge 160. As illustrated in FIGS. 1A and 2A-2C and according to an aspect, the shaped charge inlay 110 inlay may be triangularly-shaped. It is contemplated, however, that the shape of the shaped charge inlay 110 may be of any desired shape that is consistent with this disclosure.

Figure 13A:
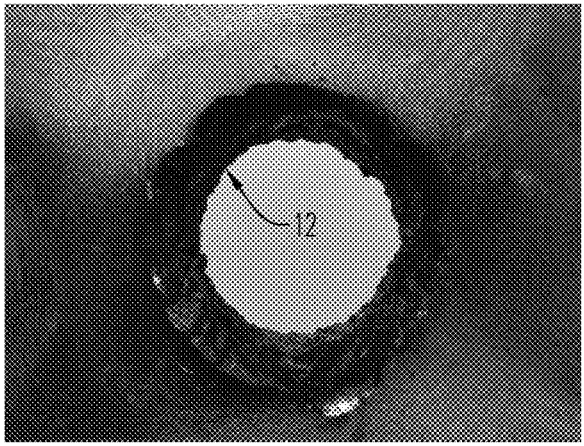
FIG. 13A (PRIOR ART)
FIG. 13A illustrates a typical perforation hole formed by a conical shaped charge, without a shaped charge inlay according to the prior art.

During detonation of the shaped charge 100, the shaped charge inlay 110 may disrupt/disturb the collapse of the existing liner 120 (described in further detail hereinbelow) in at least one direction. Such a disruption may lead to the creation of, e.g., a slot-shaped perforation 1210 (see FIG. 13B) by the liner 120 taking a resulting atypical shape (e.g., a rectangular or slotted shape) during discharge of the liner 120 from the shaped charge case 140. The atypical perforation 1200 differs from a typical perforation 12, such as, a typical round shaped perforation formed by conical shaped charges (FIG. 13A).

As illustrated in FIGS. 1B and 2, the case 140 of the shaped charge 100 within which the shaped charge inlay 110 is positioned includes a back wall 1124, an open front portion 1122, and a sidewall 1123 that extends between the back wall 1124 and the open front portion 1122. The case 140 may further include an edge 145 that circumscribes an opening of the case 140 and is defined based on a circumference of the case 140. The back wall 1124 and sidewall 1123 define a hollow interior 1121 of the case 140. An explosive load 1140 is disposed within the hollow interior 1121 of the case 140 and is positioned so that it abuts the back wall 1124 and at least a portion of the side wall 1123 adjacent the back wall 1124.

A liner 120 is disposed atop the explosive load 1140, so that the explosive load 1140 is encased within the hollow interior 1121. The liner 120 may include any shaped, such as, a conical shape, a tulip shape, a bell shape, and the like. The liner 120 may be formed from a variety of various powdered metallic and non-metallic materials and/or powdered metal alloys, and binders. According to an aspect, the liner 120 is formed from copper, pressed to form the desired liner shape. In certain exemplary embodiments, the liner material(s) may include an inert material, where an inert material may be a material that does not participate in a chemical reaction, including an exothermic chemical reaction, with the liner 120 and/or other components of the shaped charge including elements created as a result of a detonation of the shaped charge. In the same or other embodiments, the liner material may include an energetic material, where an energetic material may be a material that is capable of a chemical reaction, including an exothermic chemical reaction, with one or more components of the liner 120, the inlay 110 and/or other components of the shaped charge including elements created as a result of a detonation of the shaped charge.

The shaped charge inlay 110 is disposed above the liner 120. In an embodiment, the shaped charge inlay 110 is affixed to at least a portion of the liner 120. According to an aspect, and as illustrated in FIG. 2, the shaped charge inlay 110 is coupled or otherwise affixed to an upper edge 150 of the liner 120. The inlay 110 may be coupled to the case 140 and/or the liner 120 by, for example and without limitation, adhesives, or may be rigidly secured in place within the shaped charge case 140 by friction fit, clamps, adhesives, clips, welding, or other known techniques.

According to an aspect, a detonating device 1160, such as a detonating cord, may be in contact or communication with the explosive load 1140 through an initiation point 1150 formed in the back wall 1124, to initiate detonation of the shaped charge 100. According to an aspect, the initiation point 1150 may be an aperture (FIGS. 1A and 1B) or depression (FIG. 2) formed in the back wall 1124 of the case 140. When the detonating cord is initiated, a detonation wave (or initiation energy produced upon initiation of the detonating cord) travels along the detonating cord to the initiation point, and ultimately to the explosive load 1140. The explosive load 1140 detonates and creates a detonation wave, which generally causes the liner 120 and the inlay 110 to collapse and be ejected from the case 140, thereby producing a forward moving perforating jet. The inlay impacts the shape of the perforating jet in a manner that produces an atypical perforation hole 1200 geometry in a target. Such atypical perforation hole geometries may be a slot/rectangular hole formed by a conical shaped charge, rather than the typical circular perforation hole geometry (FIG. 13A) formed when conical shaped charges are initiated without an inlay.

Figure 2B:
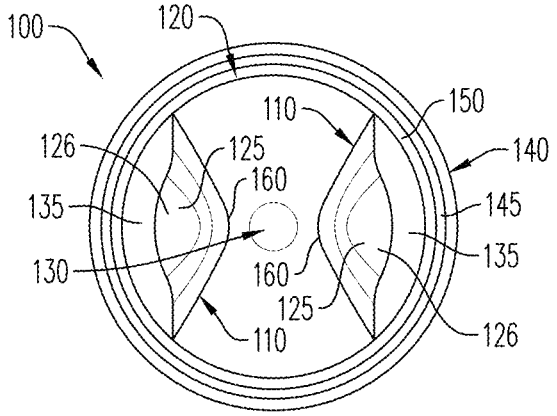
FIG. 2B is a top view of a shaped charge including a shaped charge inlay, in accordance with another exemplary embodiment.
Figure 2C:
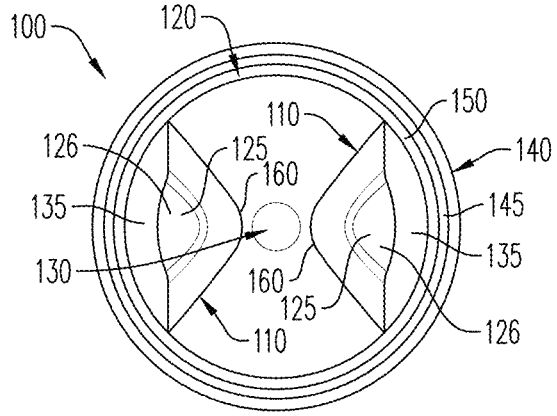
FIG. 2C is a top view of a shaped charge including a shaped charge inlay, in accordance with another exemplary embodiment.
Figure 3:
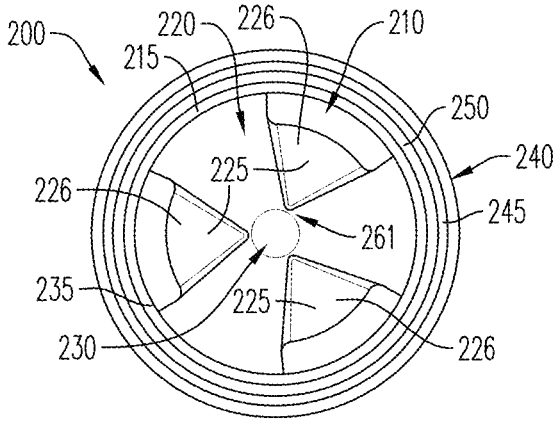
FIG. 3 is a top view of a shaped charge including a shaped charge inlay including continuous ring, in accordance with another exemplary embodiment.
Figure 4:
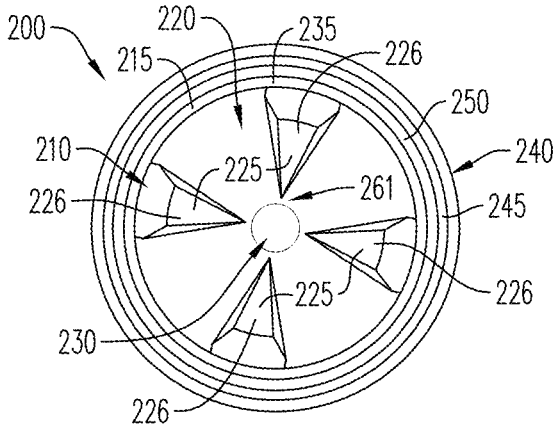
FIG. 4 is a top view of a shaped charge including a shaped charge inlay including a continuous ring, in accordance with another exemplary embodiment.
Figure 5:
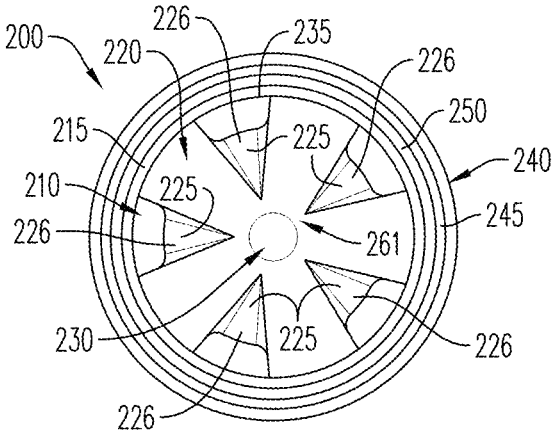
FIG. 5 is a top view of a shaped charge including a shaped charge inlay including a continuous ring, in accordance with another exemplary embodiment.
Figure 6A:
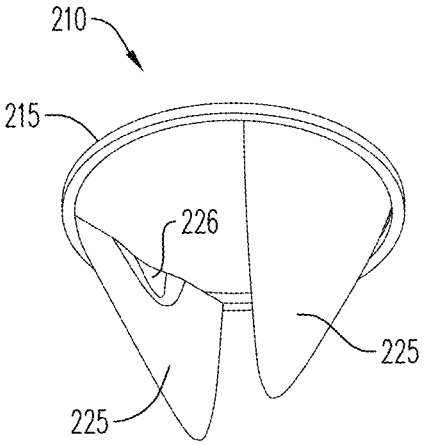
FIG. 6A is a bottom up, perspective view of a shaped charge inlay including a continuous ring, in accordance with an exemplary embodiment.
Figure 6B:
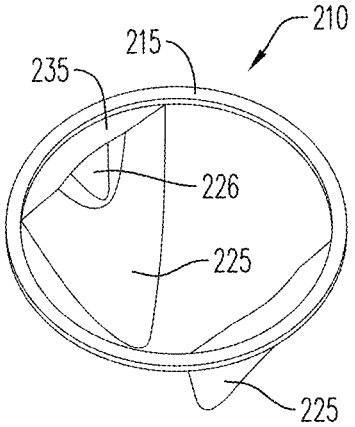
FIG. 6B is a top down, perspective view of the shaped charge inlay of FIG. 6A.
Figure 7A:
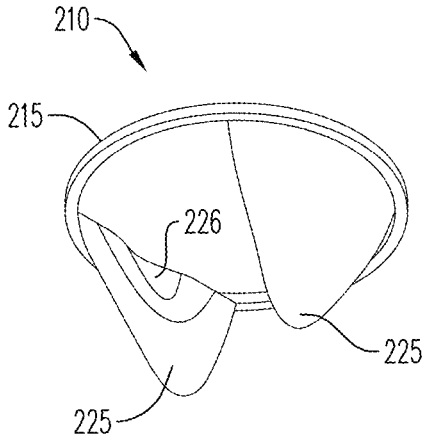
FIG. 7A is a bottom up, perspective view of a shaped charge inlay including a continuous ring, in accordance with another exemplary embodiment.
Figure 7B:
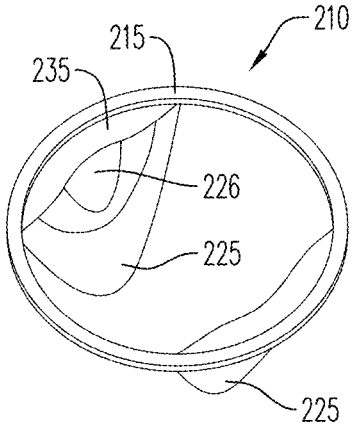
FIG. 7B is a top down, perspective view of the shaped charge inlay of FIG. 7A.

FIGS. 2A, 2B and 2C show additional exemplary embodiments of the shaped charge inlay 110. The shaped charge 100 including the shaped charge inlay 110 is illustrated from a top view. The shaped charge 100 includes the shaped charge casing 140 and the liner 120. One or more shaped charge inlays 110 may be inserted into the shaped charge 100 (e.g., as illustrated, two shaped charge inlays 110 are inserted in FIGS. 2A-2C). For purposes of convenience, and not limitation, the general characteristics of the shaped charge inlay 110 are described above with reference to FIGS. 1A, 1B and 2, and are not repeated here. As shown in FIGS. 2A, 2B and 2C, and without limitation, the shaped charge inlay 110 may take a variety of shapes and sizes and thereby cover different amounts and portions of the liner 120. For example, the exemplary shaped charge inlay 110 shown in FIG. 2B does not extend as far towards an apex 130 of the liner 120 as compared to the shaped charge inlay 110 shown in FIG. 2A. Similarly, the exemplary shaped charge inlay 110 shown in FIG. 2C also does not extend as far towards the apex 130 of the liner 120, and the shaped charge inlay 110 in FIG. 2C has a narrower profile (or covers less surface area of the liner 120) than the shaped charge inlays 110 of each of FIG. 2A and FIG. 2B.

Now referring to FIGS. 3-5 and FIG. 11, additional exemplary embodiments of shaped charges 200 and respective shaped charge inlays 210 are illustrated. Each shaped charge 200 may include a liner 220 positioned in a shaped charge case 240. The shaped charge liner 220 and case 240 are similar to the shaped charge liner 120 and case 140 described hereinabove with respect to FIGS. 1A, 1B, 2 and 2A-2C. Thus, for purposes of convenience, and not limitation, the general characteristics of the shaped charge liner 120 and case 140 are not repeated here.

Figure 11:
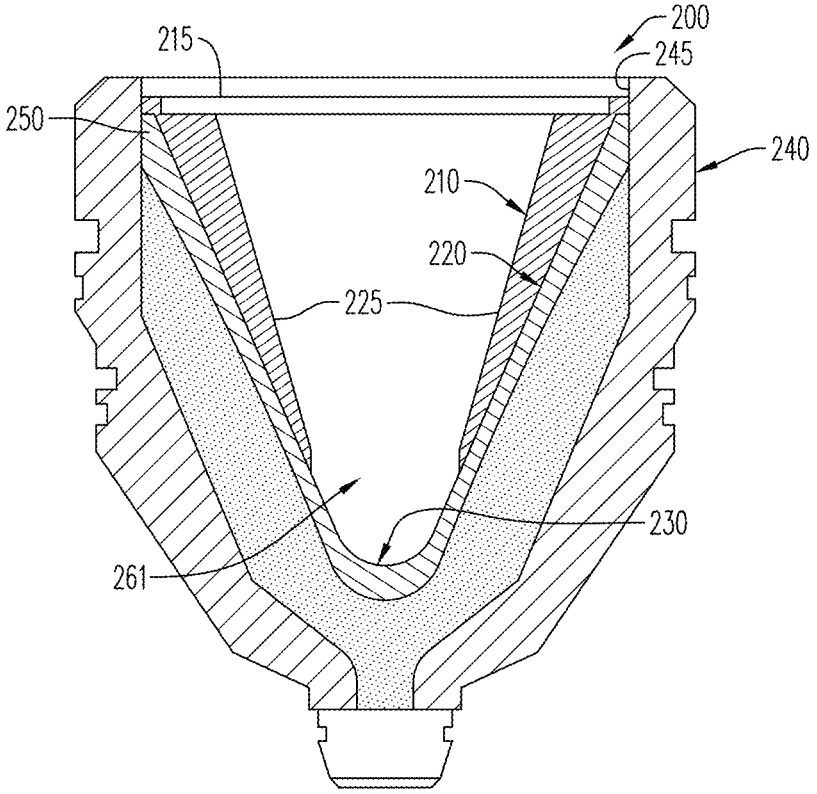
FIG. 11 is a cross-sectional view of a shaped charge including a shaped charge inlay with a continuous ring and fingers extending from the ring, in accordance with an exemplary embodiment.
Figure 12:
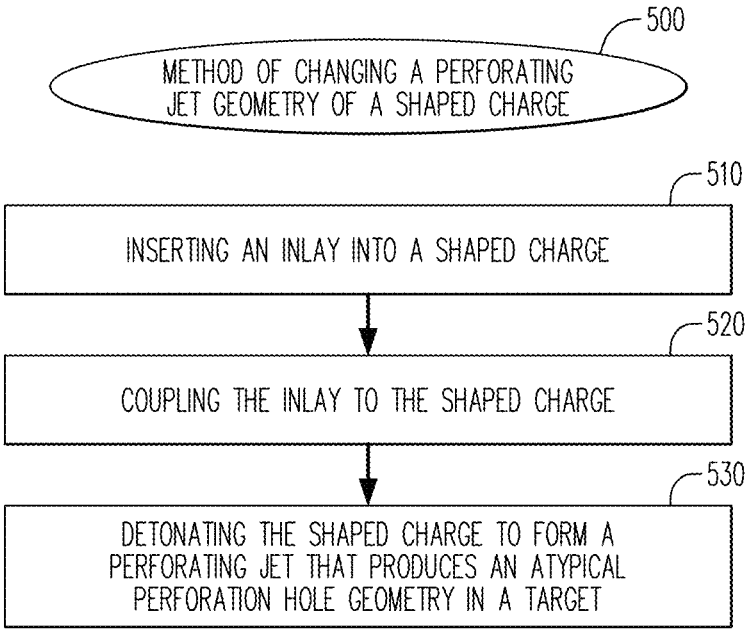
FIG. 12 is a flow chart illustrating a method of changing a perforating jet geometry of a shaped charge, using a shaped charge inlay, in accordance with an exemplary embodiment.

According to an aspect, the shaped charge inlay 210 is composed of a rigid or semi-rigid material. Such materials may be inert and may include plastics, rubbers or metals. The shaped charge inlay 210 may include an upper edge 235 and a ring/continuous ring 215 formed at the upper edge 235. According to an aspect, the case 240 of the shaped charge includes an edge 245, and the continuous ring 215 or the upper edge 235 of the inlay 210 may extend inwardly from the edge 245 of the case 240 (see, FIG. 11). According to an aspect and as illustrated in FIG. 11, the continuous ring 215 of the shaped charge inlay 210 is configured for being latched or clamped to the edge 245 of the shaped charge case 240. It is also contemplated that the continuous ring 215 may be rigidly secured above the liner 220, or to the upper edge 250 of the liner 220, within the shaped charge 200 by a friction fit or with an adhesive.

A plurality of fingers/protrusions/segments/spikes/bodies 225 may extend from the continuous ring 215 in a generally vertical direction. The plurality of fingers 225 are arranged in a manner that forms an open apex 261 of the inlay 210. The open apex 261 is the area of the fingers 225 that is furthest away from the continuous ring 215 and is generally an open area over the apex 230 of the liner 220. The continuous ring 215 couples the plurality of fingers 225 and maintains each finger in a spaced apart configuration from each other, such that when the inlay 210 is inserted into a shaped charge case 240, the continuous ring 215 circumscribes an inner circumference of the shaped charge case 240 and maintains the position of the fingers 225 along the liner 220. To be sure, the fingers 225 may also be secured to the liner 220 by adhesives, or other mechanisms, to help ensure that the contemplated transformation of the perforating jet is achieved.

In the aforementioned exemplary embodiments and other embodiments, the number and shape of fingers on a shaped charge inlay define a shape or geometry of a perforating jet and/or perforation that is produced by the shaped charge including such an inlay upon detonation. The shape and quantity of the fingers 225 of the shaped charge inlay 210 may be based on a particular requirement of the application in which they are to be used, such as the desired shape and size of the atypical perforation hole geometry. The number of fingers 225 may include 3, 4, 5, 6, or more. In certain embodiments, multiple shaped charge inlays and/or fingers of a shaped charge inlay according to the disclosure may be equally spaced around a circumference of the shaped charge and existing liner. Each finger 225, for example, may alter/transform the perforating jet to create the atypical perforation hole geometry.

Figure 13B:
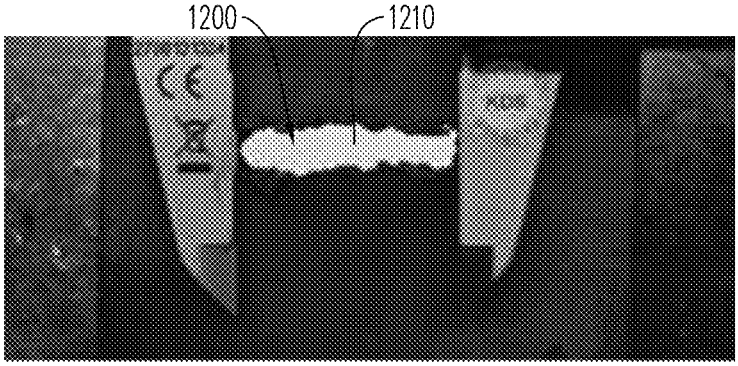
FIG. 13B illustrates an atypical perforation hole formed by a conical shaped charge including a shaped charge inlay, in accordance with an exemplary embodiment.

FIGS. 6A-6B and 7A-7B illustrate the shaped charge inlay 210 including two fingers 225. The fingers 225 are spaced 180 degrees apart from each other. Upon detonating of the shaped charge, such as a conical shaped charge, in which the two finger inlay is positioned, the resulting atypical perforation hole geometry 1200 is a slot/rectangular perforation hole 1210, as illustrated in FIG. 13B. In the exemplary embodiments shown in FIGS. 6A-6B and 7A-7B, each of the plurality of fingers 225 further define an indented area 226. As illustrated in FIGS. 3-5, FIG. 8B, FIG. 9B and FIG. 10B, for example, the indented area 226 may extend from the upper edge 235 to a distal edge/end of the fingers 225. The indented area 226 facilitates at least a partial disruption of the perforating jet in order to form the desired atypical perforation hole geometry. In some embodiments, the two fingers 225 may be spaced 180 degrees apart from each other on the continuous ring 215 where each finger spans between 20 to 160 degrees of the circumference of the continuous ring 215.

Figure 8A:
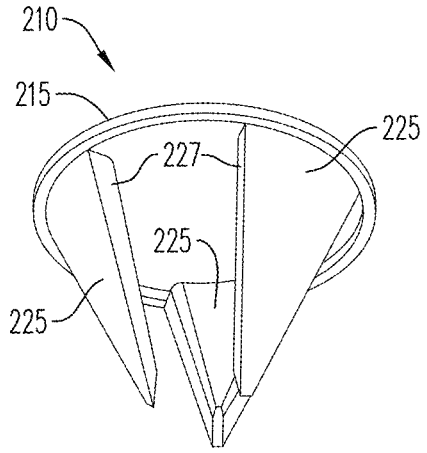
FIG. 8A is a bottom up, perspective view of a shaped charge inlay including a continuous ring, in accordance with another exemplary embodiment.
Figure 8B:
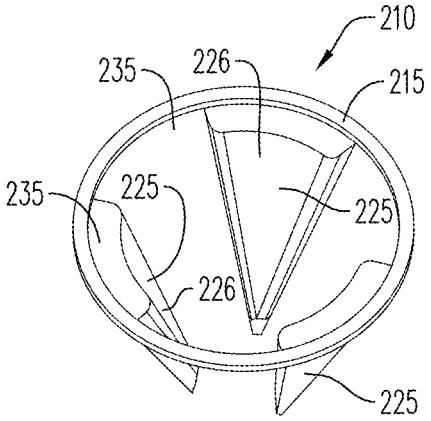
FIG. 8B is a top down, perspective view of the shaped charge inlay of FIG. 8A.
Figure 14:
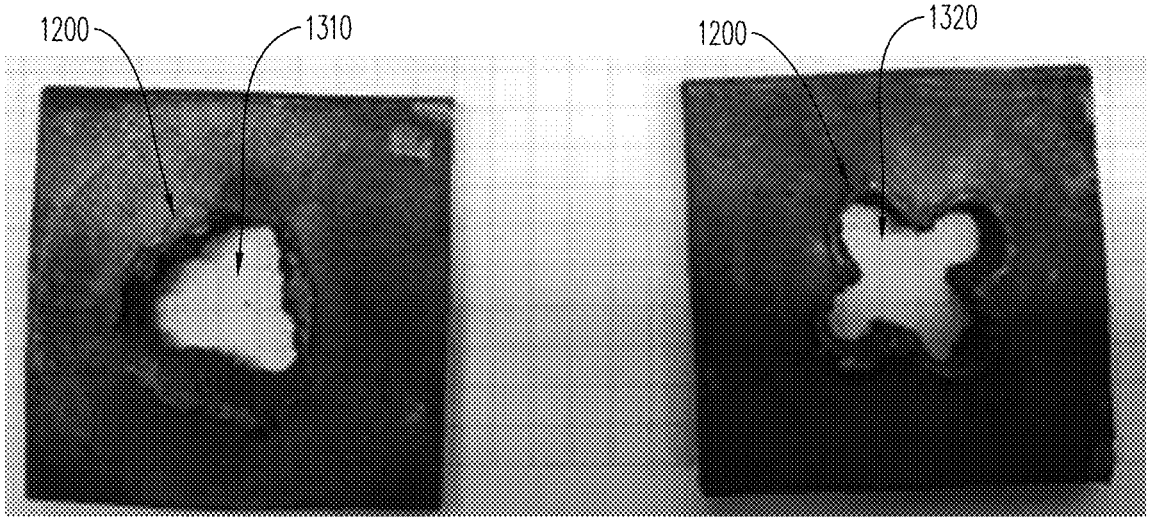
FIG. 14 illustrates atypical perforation holes formed using a shaped charge inlay, in accordance with an exemplary embodiment.

FIGS. 8A-8B illustrate the shaped charge inlay 210 including three fingers 225. The three fingers 225 are spaced 60 degrees apart from each other. According to an aspect, each finger 225 spans 60 degrees of a circumference of the continuous ring 215 of the inlay 210. Upon detonating of the shaped charge 200, such as a conical shaped charge, in which the three finger inlay is positioned, the resulting atypical perforation hole geometry 1200 is a triangularly-shaped perforation hole 1310, as illustrated in FIG. 14. In the exemplary embodiments shown in FIGS. 8A-8B, each of the plurality of fingers 225 includes a beveled edge 227. The beveled edge 227 may enhance the strength and/or the rigidity of the fingers 225. In some embodiments, the three fingers 225 may be spaced 60 degrees apart from each other on the continuous ring 215 where each finger spans between 20 to 100 degrees of the circumference of the continuous ring 215.

Figure 9A:
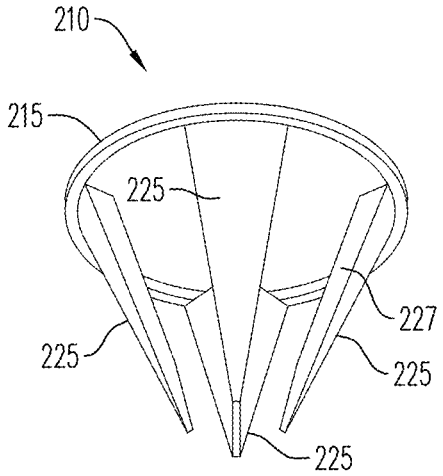
FIG. 9A is a bottom up, perspective view of a shaped charge inlay including a continuous ring, in accordance with another exemplary embodiment.
Figure 9B:
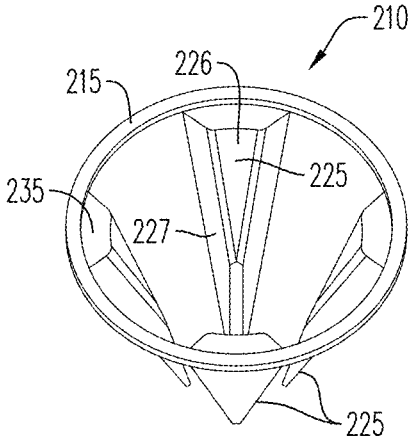
FIG. 9B is a top down, perspective view of the shaped charge inlay of FIG. 9A.

FIGS. 9A-9B illustrate the shaped charge inlay 210 including four fingers 225. The four fingers 225 are spaced 45 degrees apart from each other. In this embodiment, each finger 225 spans 45 degrees of the circumference of the continuous ring 215. Detonation of the shaped charge 200 (e.g., a conical shaped charge) including the four finger inlay forms a perforating jet that creates an X-shaped perforation hole 1320, as illustrated in FIG. 14. According to an aspect, the fingers 225 may include the aforementioned beveled edge 227. In some embodiments, the four fingers 225 may be spaced 45 degrees apart from each other on the continuous ring 215 where each finger spans between 15 to 75 degrees of the circumference of the continuous ring 215.

Figure 10A:
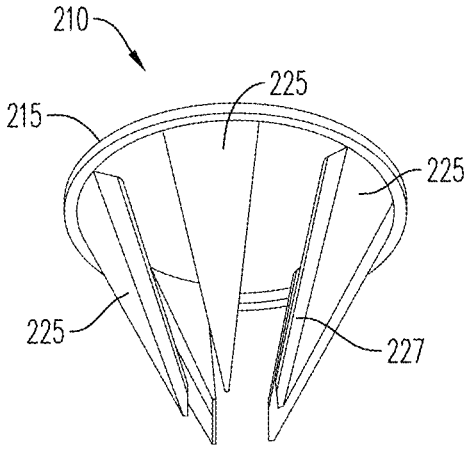
FIG. 10A is a bottom up, perspective view of a shaped charge inlay including a continuous ring, in accordance with another exemplary embodiment.
Figure 10B:
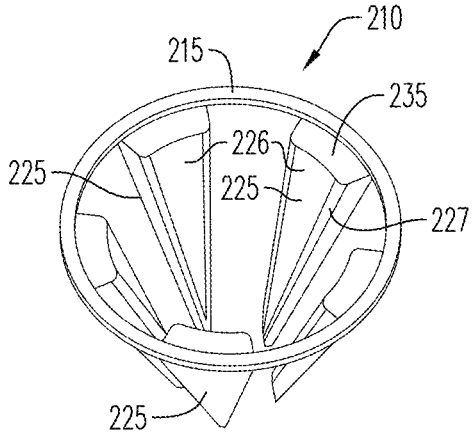
FIG. 10B is a top down, perspective view of the shaped charge inlay of FIG. 10A.
Figure 15:
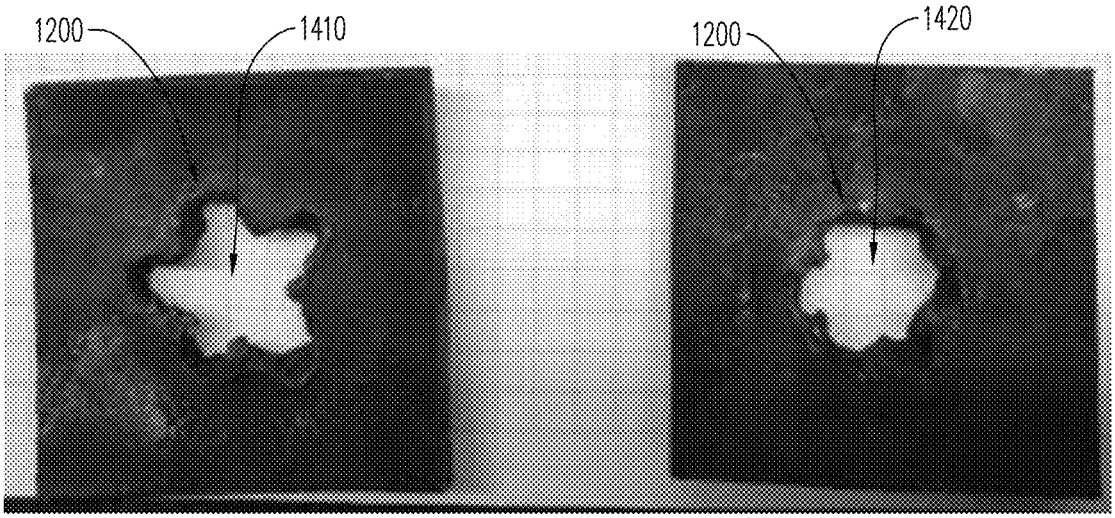
FIG. 15 illustrates atypical perforation holes formed using a shaped charge inlay, in accordance with an exemplary embodiment.

FIGS. 10A-10B illustrate the shaped charge inlay 210 including five fingers 225. The five fingers 225 are spaced about 36 degrees apart from each other. In this embodiment, each finger 225 spans 36 degrees of the circumference of the continuous ring 215. Detonation of the shaped charge 200 (e.g., a conical shaped charge) including the five finger inlay forms a perforating jet that creates a star-shaped perforation hole 1410, as illustrated in FIG. 15. According to an aspect, the finger 225 may include the aforementioned beveled edge 227. In some embodiments, the five fingers 225 may be spaced 36 degrees apart from each other on the continuous ring 215 where each finger spans between 10 to 60 degrees of the circumference of the continuous ring 215.

FIG. 15 further illustrates a daisy-shaped perforation hole 1420, which may be formed from a shaped charge inlay 210 including at least six fingers 225. The fingers 225 may include beveled edges 227, such as those illustrated in FIGS. 8A-8B, 9A-9B and 10A-10B, to add strength and rigidity to the fingers 225.

Figure 16A:
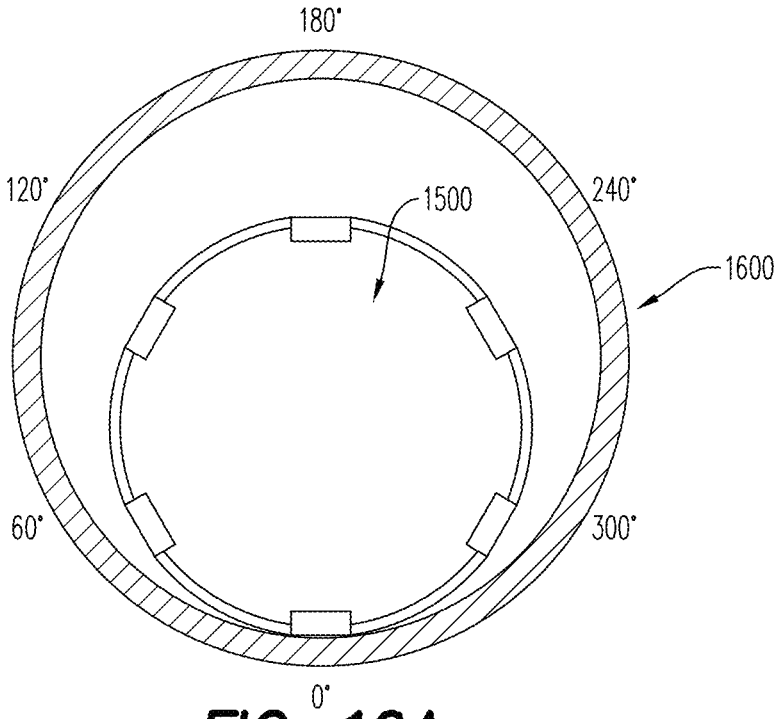
FIG. 16A illustrates a side, cross-sectional view of a decentralized perforating gun positioned in a wellbore casing and configured for receiving the shaped charge of FIG. 1A or FIG. 11.
Figure 16B:
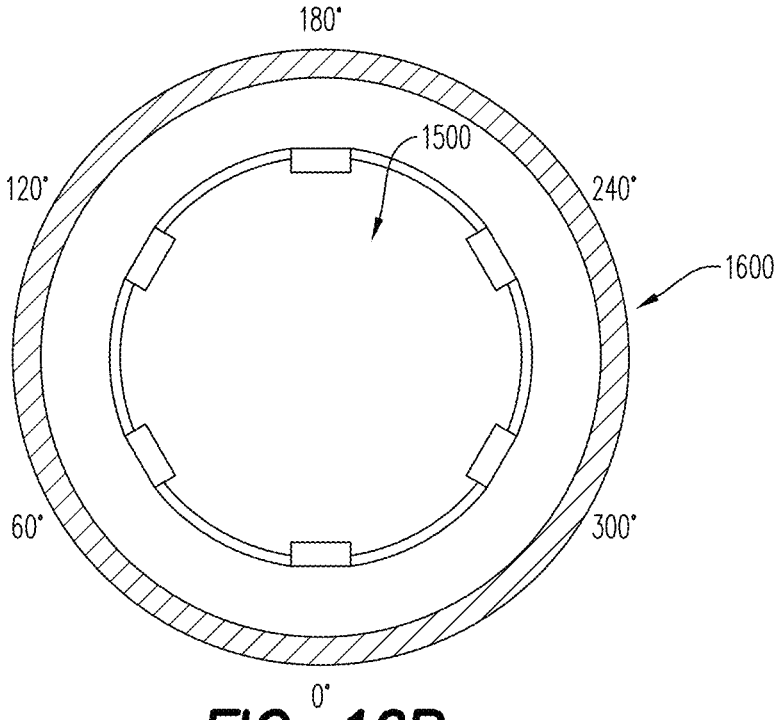
FIG. 16B illustrates a side, cross-sectional view of a centralized perforating gun positioned in a wellbore casing and configured for receiving the shaped charge of FIG. 1A or FIG. 11.
Figure 17A:
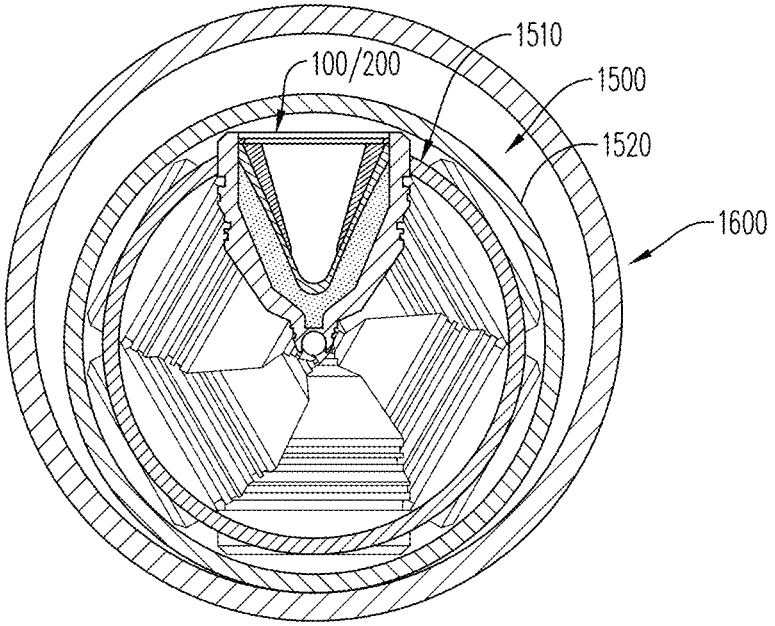
FIG. 17A illustrates a side, cross-sectional view of a centralized perforating gun positioned in a wellbore casing and including a shaped charge of FIG. 1A or FIG. 11.
Figure 17B:
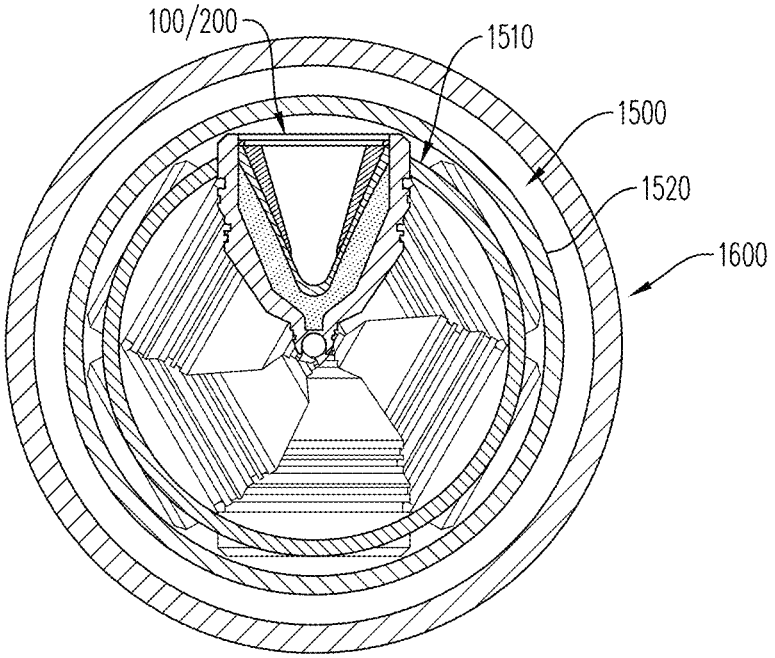
FIG. 17B illustrates a side, cross-sectional view of a decentralized perforating gun positioned in a wellbore casing and including a shaped charge of FIG. 1A or FIG. 11.

Embodiments of the disclosure further relate to a method 500 of changing a perforating jet geometry of a shaped charge. The method 500 includes using one or more shaped charge inlays 110/210 in conjunction with a shaped charge 100/200. As illustrated in the flow chart of FIG. 5, a shaped charge inlay may be inserted/placed 510 into a shaped charge that includes an existing liner. The liner may be of any standard liner shape/configuration, such as, conical, tulip, bell, or the like. The shaped charge inlay may be coupled or otherwise coupled 520 to the shaped charge. The shaped charge inlay may be affixed to the existing liner (as previously discussed) by, for example and without limitation, adhesives, or may be rigidly secured in place within a shaped charge case by friction fit, clamps, adhesives, clips, welding, or other known techniques. The shaped charge may thereafter be installed within a carrier of a perforating gun. The shaped charge may be detonated 530 while positioned in a wellbore (FIGS. 16A-16B). During detonation, the shaped charge inlay may disturb a collapse of the liner, thereby causing the liner to create a perforation and/or perforating jet that defines a different geometry than a typical geometry (see, for instance, FIG. 13A, illustrating the geometry formed by a conical shaped charge) that would be created by detonating the shaped charge without the shaped charge inlay. For example, the shaped charge inlay may create a slot-shaped perforation even though the shaped charge is a conical shaped charge. FIGS. 13B-15 show exemplary atypical perforations 1200, such as a slot-shaped perforation 1210 (FIG. 13B), a triangle-shape perforation 1310 (FIG. 14) and a star-shaped perforation 1410 (FIG. 15) created by a conical shaped charge, using the shaped charge inlays 110/210 described hereinabove.

Embodiments of the disclosure are associated with a perforating gun 1500 (FIGS. 16A-16B and FIGS. 17A-17B) for receiving a plurality of shaped charges, such as the shaped charges 100 of the exemplary embodiments described hereinabove. Each shaped charge 100 includes a shaped charge case 140 having a geometry that defines the overall geometry of the shaped charge 100. According to an aspect, at least one part of the shaped charge case 140 not rotationally symmetric. It is contemplated that at least one part of the shaped charge (such as the shape charge case, liner or explosive load) is rotationally symmetric.

The shaped charge case 140 includes a hollow interior 1121 and an explosive load 1140 disposed within the hollow interior 1121. According to an aspect, the explosive load 1140 extends from the back wall 1124 of the case 140 to the open front portion, at least partially filling the hollow interior 1121. The explosive load 1140 is retained in the hollow interior 1121 by a liner 120. As described hereinabove, the liner 120 is composed of a variety of powdered metallic and non-metallic materials and/or powdered metal alloys pressed to form a desired liner shape.

As described hereinabove, a shaped charge inlay 110, 210 may be disposed on top of a portion of the liner 120. In this configuration, at least a portion of the liner 120 is between the inlay 110, 210 and the explosive load (see, for example, FIG. 1B, FIG. 2 and FIG. 11). The shaped charge inlay 110, 210 may be configured substantially as described hereinabove with respect to FIGS. 1A-1B, FIG. 2 and FIGS. 2A-2C or with respect to FIGS. 3-11.

Each shaped charge 100, upon detonation, may form a perforating jet that creates an atypical perforation hole geometry in a target. The inlay 110, 210 defines a shape of the perforating jet to create the corresponding atypical perforation hole geometry. The atypical perforation hole geometries created by the shaped charges 100 include constant open areas to flow (AOF) (the open areas representing the perforations, such as those illustrated in FIGS. 13B-15) in the target. The constant open areas are created when the perforating gun is centralized (FIG. 16B) or decentralized (FIG. 16A) in a wellbore or wellbore casing. In addition, the constant open areas are created when the target may include wellbore casings, cement, and/or a rock formation including sandstone, shales or carbonates. The open areas to flow of the perforation hole geometries may deviate or vary from each other. As used herein, the term "variation" means a change, diversion or difference in the size of the perforation holes formed in a target, even though the perforation holes are created by identical shaped charges. The area open to flow of the slot-shaped perforations may be measured with an image processing software or may be approximated using the following formula:

$$AOF = W \times H$$

wherein AOF is the area open to flow, W is the average width of the slot-shaped perforation, and H is the average height of the slot-shaped perforation.

According to an aspect, the plurality of shaped charges 100 include a first shaped charge and a second shaped charge. The variation between the open area to flow of the perforation hole geometry of the first shaped charge and the open area to flow of the perforation hole geometry of the second shaped charge may be less than 20%. In an embodiment, upon detonation of the first shaped charge and the second shaped charge, the open areas to flow of the atypical perforation hole geometries formed by the first and second shaped charges has a variation that is less than 15%. According to an aspect, the plurality of shaped charges 100 includes more than two shaped charges, such as, six shaped charges. The variation between the open area to flow of the perforation hole geometries of the six shaped charges may be less than 10%, that is, the open areas to flow are constant open areas to flow. According to an aspect the variation may be less than 7%. The shaped charges 100, in combination with the inlays 110, 210, produce constant open areas to flow having variations of less than 10% when the gun is decentralized (FIG. 16A) or when the gun is centralized (FIG. 16B) in the wellbore 1600.

Embodiments of the disclosure are further associated with a method of perforating a wellbore using a perforating gun configured substantially as described hereinabove. The contemplated perforating gun includes a plurality of shaped charges each having an inlay coupled thereto. The shaped charges and their associated inlays may have a design as described with respect to FIGS. 1A-11. The method includes positioning the perforating gun in an underground formation/wellbore (see, for example, FIGS. 16A-16B). When the perforating gun is in the formation, it may be decentralized (FIG. 16A) or centralized (FIG. 16), which depends at least in part on the inclination of the wellbore. The underground formation may include sandstone, shales or carbonates or any other rock type to be perforated. As would be understood by one of ordinary skill in the art, the wellbore may include one or more wellbore casings (such as, one inner casing positioned in an outer casing), which may or may not be cemented in the wellbore. The shaped charges are detonated to create atypical perforations in the formation. According to an aspect, the shaped charges are conical shaped charges, with at least one non-cylindrical symmetric portion, and the atypical perforations are slot-shaped perforating hole geometries formed by the conical shaped charges. According to an aspect, the slot-shaped perforation hole geometries include constant open areas to flow. The constant open areas to flow of the perforation hole geometries, such as the slot-shaped perforation hole geometries, include a variation that is less than 20% (for example, between two shaped charges). The variation may be less than 10%, between more than two shaped charges. According to an aspect, the variation is less than 7%. The method further includes injecting a fluid into the wellbore to fracture the underground formation. During the injecting process, the slot-shaped perforations are eroded by the fluid, which leads to larger perforation holes. Since erosion takes place where fluid flow is the highest, and the slot-shaped perforations are elongated openings, the slot-shaped perforations formed by this method are flow optimized and ideal for fracturing applications.

EXAMPLES

Various perforating gun assemblies were made and tested according to the embodiments of the disclosure. Each perforating gun included six (6) conical shaped charges positioned in a cylindrical shaped charge carrier (phased 60-degrees apart) with a detonating cord extending through a body of the carrier and in communication with each shaped charge. Each shaped charge included an explosive load of cyclotrimethylenetrinitramine (RDX) and a liner positioned atop the explosive load. The shaped charges were detonated in a casing filled with a fluid to mimic the wellbore environment. The open areas presented in Tables 1-4 below are based on the total open area measured and calculated upon formation of perforations in the casing. To obtain the open areas, the maximum and minimum widths of the perforation hole in the casing were measured and averaged, and the average width was multiplied by the maximum height of the perforation hole in the casing.

TABLE 1

(Test 1)

| Shaped Charge Phasing | Clearance (mm) | Open Area ($mm^2$) |
|---|---|---|
| 0° | 4 | 87 |
| 60° | 9 | 82 |
| 120° | 18 | 83 |
| 180° | 25 | 71 |
| 240° | 18 | 71 |
| 300° | 9 | 77 |

To obtain the data in Table 1, standard conical shaped charges were positioned in perforating gun. Each shaped charge was phased at 60° from adjacent shaped charges. The perforating gun was positioned in a casing in a decentralized manner so that the clearance between the perforating gun and the casing varied along the length of the perforating gun. The shaped charges were detonated so that a perforating jet penetrated and formed circular-shaped perforations in the casing. The open area of each perforation was measured. As indicated in Table 1, the size of the perforations ranged from 71 $mm^2$ to 87 $mm^2$.

TABLE 2

(Test 2)

| Shaped Charge Phasing | Clearance (mm) | Open Area ($mm^2$) |
|---|---|---|
| 0° | 4 | 245 |
| 60° | 9 | 230 |
| 120° | 18 | 224 |
| 180° | 25 | 249 |
| 240° | 18 | 221 |
| 300° | 9 | 228 |

To obtain the data in Table 2, standard conical shaped charges were equipped with inlays configured generally as shown in FIGS. 6A-6B and FIGS. 7A-7B and described hereinabove. The inlays, each having two finger equidistantly spaced apart, were affixed to the liner of each shaped charge. Each shaped charge was positioned in a perforating gun, phased at 60° from adjacent shaped charges and arranged so that the fingers of the inlays were perpendicular to the body of the perforating gun. The perforating gun was positioned in a casing in a decentralized manner so that the clearance between the perforating gun and the casing varied along the length of the perforating gun. The shaped charges were detonated so that a perforating jet penetrated and formed slot-shaped perforations in the casing. The open area of each perforation was measured. As indicated in Table 2, the size of the open areas of the perforations ranged from 221 $mm^2$ to 249 $mm^2$, a marked increase in size from the data in Table 1.

TABLE 3

(Test 3)

| Shaped Charge Phasing | Clearance (mm) | Open Area ($mm^2$) |
|---|---|---|
| 0° | 4 | 333 |
| 60° | 9 | 306 |
| 120° | 18 | 359 |
| 180° | 25 | 326 |
| 240° | 18 | 307 |
| 300° | 9 | 289 |

To obtain the data in Table 3, standard conical shaped charges were configured substantially as described hereinabove with respect to the arrangement of the conical shaped charges of Test 2. The inlays of the shaped charges tested in Test 3 were arranged in a different manner than Test 2, in that the shaped charges were positioned in the perforating so that the two fingers of the inlays extend in the same direction as the body of the perforating gun. The shaped charges in the decentralized perforating gun were detonated so that a perforating jet penetrated and formed slot-shaped perforations in the casing. The open area of each slot-shaped perforation was measured, and as indicated in Table 3, the size of the open areas of the perforations ranged from 289 $mm^2$ to 359 $mm^2$—a marked increase in size from the data in Table 1 and the data in Table 2.

TABLE 4

| Shaped Charge Phasing | Clearance (mm) | Open Area ($mm^2$) |
|---|---|---|
| 0° | 4 | 279 |
| 60° | 9 | 260 |
| 120° | 18 | 297 |
| 180° | 25 | 407 |
| 240° | 18 | 378 |
| 300° | 9 | 312 |

To obtain the data in Table 4, standard conical shaped charges as described hereinabove with respect to Tests 2 and 3 were used. The inlays of the shaped charges tested in Test 4 were arranged in the perforating gun in a different manner than in Tests 2 and 3, in that the shaped charges were positioned in the perforating so that the fingers of the inlays were at a 45° angle to a length of the perforating gun. The shaped charges in the decentralized perforating gun were detonated so that a perforating jet penetrated and formed slot-shaped perforations in the casing. The open area of each slot-shaped perforation was measured, and as indicated in Table 4, the size of the open areas of the perforations ranged from 260 $mm^2$ to 407 $mm^2$—a marked increase in size from the open areas of the standard conical shaped charges (with no inlays) tested and the data of which is presented in Table 1.

The data presented in the Tables 2-4 indicated that the perforations created by the conical shaped charges equipped with inlays were not only elongated/slot-shaped, which is ideal for fracturing applications. It was also observed that the perforations may also have enlarged surface areas.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A method of creating slot-shaped perforations in a wellbore in an underground formation, the method comprising:

positioning a plurality of perforating gun assemblies in the wellbore, wherein each perforating gun assembly includes a conical shaped charge comprising:

a shaped charge case comprising a hollow interior;

an explosive load disposed within the hollow interior;

a liner disposed adjacent the explosive load, wherein the liner is configured to retain the explosive load in the hollow interior; and a shaped charge inlay disposed above a portion of the liner, such that at least the portion of the liner is between the inlay and the explosive load;

detonating the conical shaped charge of one of the perforating gun assemblies into the underground formation; and detonating the conical shaped charge of another one of the perforating gun assemblies into the underground formation, wherein detonating the conical shaped charge of each perforating gun assembly includes forming, via the corresponding inlay, a modified perforating jet that creates a slot-shaped perforation hole geometry in the underground formation, wherein a respective open area to flow of each slot-shaped perforation hole geometry formed by the conical shaped charges of the corresponding perforating gun assembly is constant among all the slot-shaped perforation hole geometries.

2. The method of claim 1, wherein a position of any one of the perforating gun assemblies in the wellbore is decentralized.

3. The method of claim 2, wherein a variation of the constant open areas to flow between the slot-shaped perforation hole geometries is less than 15%.

4. The method of claim 3, wherein the variation between the open areas to flow between the slot-shaped perforation hole geometries is less than 10%.

5. The method of claim 1, wherein the inlay defines a shape of the perforating jet to create a corresponding atypical perforation hole geometry in the underground formation.

6. The method of claim 1, further comprising:

injecting a fluid into the wellbore to fracture the underground formation.

7. The method of claim 1, wherein the shaped charge inlay comprises:

a continuous ring; and one or more fingers extending from the continuous ring, wherein the one or more fingers are spaced apart from each other, and each of the one or more fingers define an open apex of the shaped charge inlay.

8. The method of claim 7, wherein at least one of the continuous ring and the one or more fingers are affixed to the shaped charge liner by an adhesive or a friction fit.

9. The method of claim 8, wherein the shaped charge inlay comprises:

an upper edge comprising the continuous ring, wherein the fingers comprise a distal edge opposite the upper edge, and a body extending between the upper edge and the distal edge.

10. The method of claim 1, wherein the underground formation comprises sandstone, shales or carbonates.

* * * * *